US011272760B2

(12) United States Patent
Hopkins et al.

(10) Patent No.: US 11,272,760 B2
(45) Date of Patent: Mar. 15, 2022

(54) SOLE STRUCTURE INCLUDING CANTILEVERED OUTSOLE ELEMENTS

(71) Applicant: NIKE, Inc., Beaverton, OR (US)

(72) Inventors: Timothy P. Hopkins, Lake Oswego, OR (US); Oliver McLachlan, Beaverton, OR (US); Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 83 days.

(21) Appl. No.: 16/683,436

(22) Filed: Nov. 14, 2019

(65) Prior Publication Data

US 2020/0154831 A1 May 21, 2020

Related U.S. Application Data

(60) Provisional application No. 62/925,776, filed on Oct. 25, 2019, provisional application No. 62/767,875, filed on Nov. 15, 2018.

(51) Int. Cl.

| | |
|---|---|
| ***A43B 13/22*** | (2006.01) |
| ***A43B 13/12*** | (2006.01) |
| *A43B 13/18* | (2006.01) |

(52) U.S. Cl.

CPC ..... *A43B 13/22* (2013.01); *A43B 13/122* (2013.01); *A43B 13/185* (2013.01)

(58) Field of Classification Search

CPC ..... A43B 13/185; A43B 13/22; A43B 13/223; A43B 13/122; A43B 13/125; A43B 13/127

See application file for complete search history.

(56) References Cited

U.S. PATENT DOCUMENTS

| | | | | |
|---|---|---|---|---|
| 2,853,809 | A * | 9/1958 | Bianchi | A43B 13/223 36/59 C |
| 6,327,795 | B1 * | 12/2001 | Russell | A43B 13/145 36/27 |
| 6,330,757 | B1 * | 12/2001 | Russell | A43B 13/18 36/28 |
| 7,549,236 | B2 * | 6/2009 | Dillon | A43B 13/184 36/25 R |
| 2005/0268491 | A1 | 12/2005 | McDonald et al. | |
| 2007/0209230 | A1 * | 9/2007 | Dillon | A43B 13/183 36/25 R |

(Continued)

OTHER PUBLICATIONS

European Patent Office (ISA), International Search Report and Written Opinion for International Application No. PCT/US2019/061496, dated Mar. 19, 2020.

*Primary Examiner* — Ted Kavanaugh
(74) *Attorney, Agent, or Firm* — Honigman LLP; Matthew H. Szalach; Jonathan O'Brien

(57) ABSTRACT

A sole structure for an article of footwear is provided and includes a first sole plate formed at least in part from a first material having a first stiffness and including a first ground-engaging portion and a second ground-engaging portion, the first ground-engaging portion defining a first aperture extending around the second ground-engaging portion. The sole structure further including a membrane coupled to the first ground-engaging portion and the second ground-engaging portion and at least partially exposed by the first aperture, the membrane formed at least in part from a second material having a second stiffness that is less than the first stiffness.

18 Claims, 16 Drawing Sheets

(56) References Cited

U.S. PATENT DOCUMENTS

| | | | |
|---|---|---|---|
| 2014/0075777 | A1 | 3/2014 | Bruce et al. |
| 2016/0000185 | A1 | 1/2016 | Cook et al. |
| 2016/0302523 | A1 | 10/2016 | Fujita et al. |
| 2017/0251754 | A1 | 9/2017 | Meschter et al. |

* cited by examiner

SOLE STRUCTURE INCLUDING CANTILEVERED OUTSOLE ELEMENTS

CROSS REFERENCE TO RELATED APPLICATIONS

This patent application claims the benefit of U.S. Provisional Application 62/767,875, filed on Nov. 15, 2018, and of U.S. Provisional Application 62/925,776, filed on Oct. 25, 2019, the disclosures of which are considered part of the disclosure of this application and are hereby incorporated by reference in their entirety.

FIELD

The present disclosure relates generally to an article of footwear, and more particularly to a sole structure for an article of footwear having cantilevered outsole elements.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground-engaging surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

While known sole structures have proven acceptable for their intended purposes, a continuous need for improvement in the relevant art remains. For example, a need exists for an outsole that provides improved traction with the ground surface when forces having varying magnitude and direction are applied from the midsole or the upper to the outsole. A need also exists for an article of footwear having improved overall comfort and fit while providing such improved traction.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
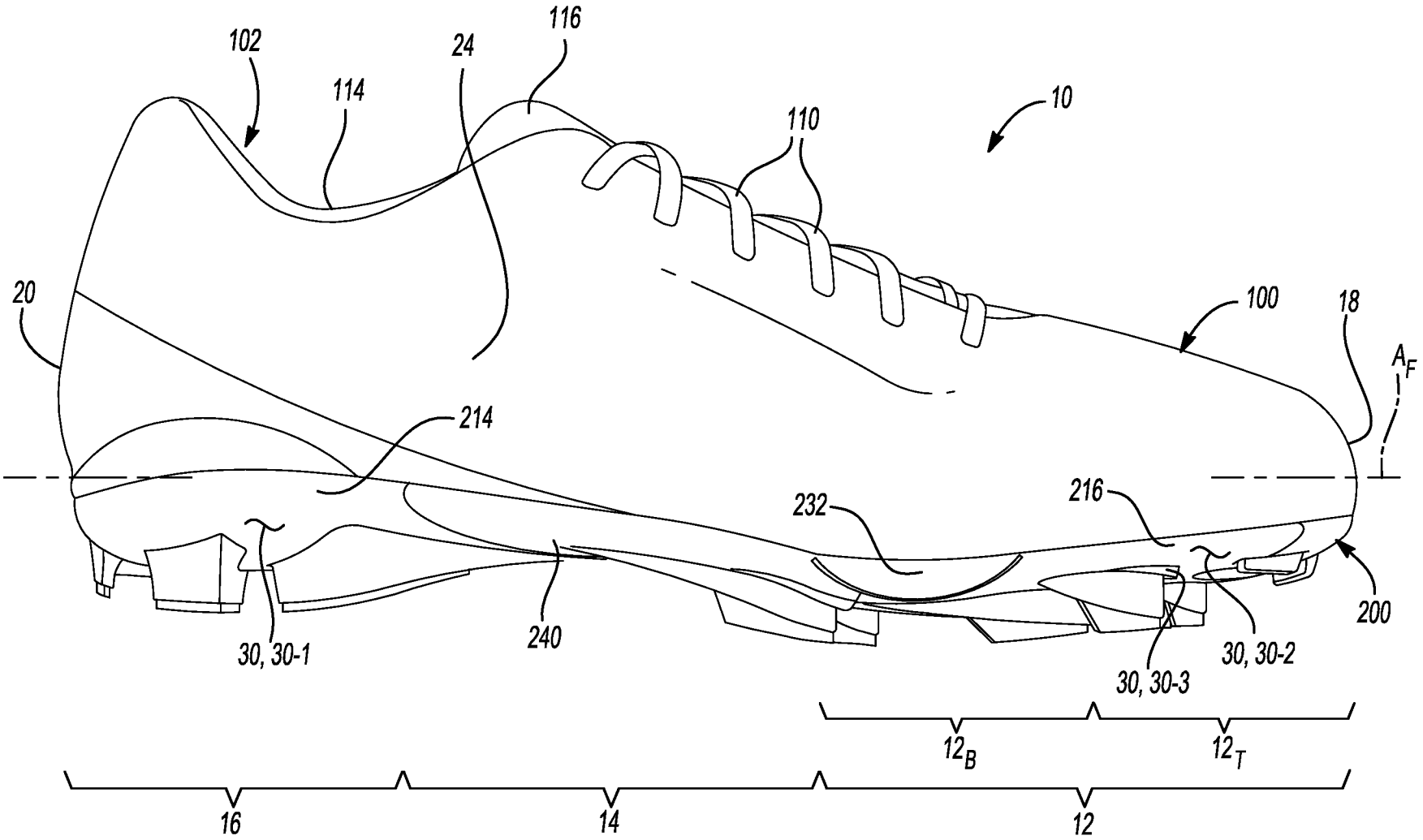
FIG. 1 is a side elevation view of an article of footwear in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear is provided and includes a first sole plate formed at least in part from a first material having a first stiffness and including a first ground-engaging portion and a second ground-engaging portion, the first ground-engaging portion defining a first aperture extending around the second ground-engaging portion. The sole structure further including a membrane coupled to the first ground-engaging portion and the second ground-engaging portion and at least partially exposed by the first aperture, the membrane formed at least in part from a second material having a second stiffness that is less than the first stiffness.

In one configuration, the first material may have a first modulus of elasticity and the second material may have a second modulus of elasticity different than the first modulus of elasticity.

The sole structure may additionally include a second sole plate, the membrane being disposed between the first sole plate and the second sole plate. The second sole plate may define a recess, the membrane being disposed within the recess. Additionally or alternatively, the first sole plate may be disposed within the recess.

In one configuration, the first aperture may define one of a V-shape or a U-shape. Additionally or alternatively, the membrane may be at least partially disposed within the first aperture. Further, the membrane may define a first protrusion at least partially disposed within the first aperture. The first protrusion may define one of a V-shape or a U-shape.

The second ground-engaging portion may be cantilevered from the first ground-engaging portion. Additionally or alternatively, a traction element may be disposed on the second ground-engaging portion. Further, the second ground-engaging portion may be configured to move relative to the first ground-engaging portion when the first sole plate flexes from a first position to a second position.

The sole structure may be incorporated into an article of footwear.

In another configuration, a sole structure for an article of footwear is provided and includes a first sole plate formed at least in part from a first material having a first stiffness and including a first ground-engaging portion and a second ground-engaging portion, the second ground-engaging portion cantilevered from the first ground-engaging portion and extending into a first aperture defined by the first ground-engaging portion. The sole structure further including a membrane coupled to the first ground-engaging portion and the second ground-engaging portion and at least partially exposed by the first aperture, the membrane formed at least in part from a second material having a second stiffness that is less than the first stiffness.

In one configuration, the first material may have a first modulus of elasticity and the second material may have a second modulus of elasticity different than the first modulus of elasticity.

The sole structure may additionally include a second sole plate, the membrane being disposed between the first sole plate and the second sole plate. The second sole plate may define a recess, the membrane being disposed within the recess. Additionally or alternatively, the first sole plate may be disposed within the recess.

In one configuration, the first aperture may define one of a V-shape or a U-shape. Additionally or alternatively, the membrane may be at least partially disposed within the first aperture. Further, the membrane may define a first protrusion at least partially disposed within the first aperture. The first protrusion may define one of a V-shape or a U-shape.

Additionally or alternatively, a traction element may be disposed on the second ground-engaging portion. Further, the second ground-engaging portion may be configured to move relative to the first ground-engaging portion when the first sole plate flexes from a first position to a second position.

The sole structure may be incorporated into an article of footwear.

Figure 2:
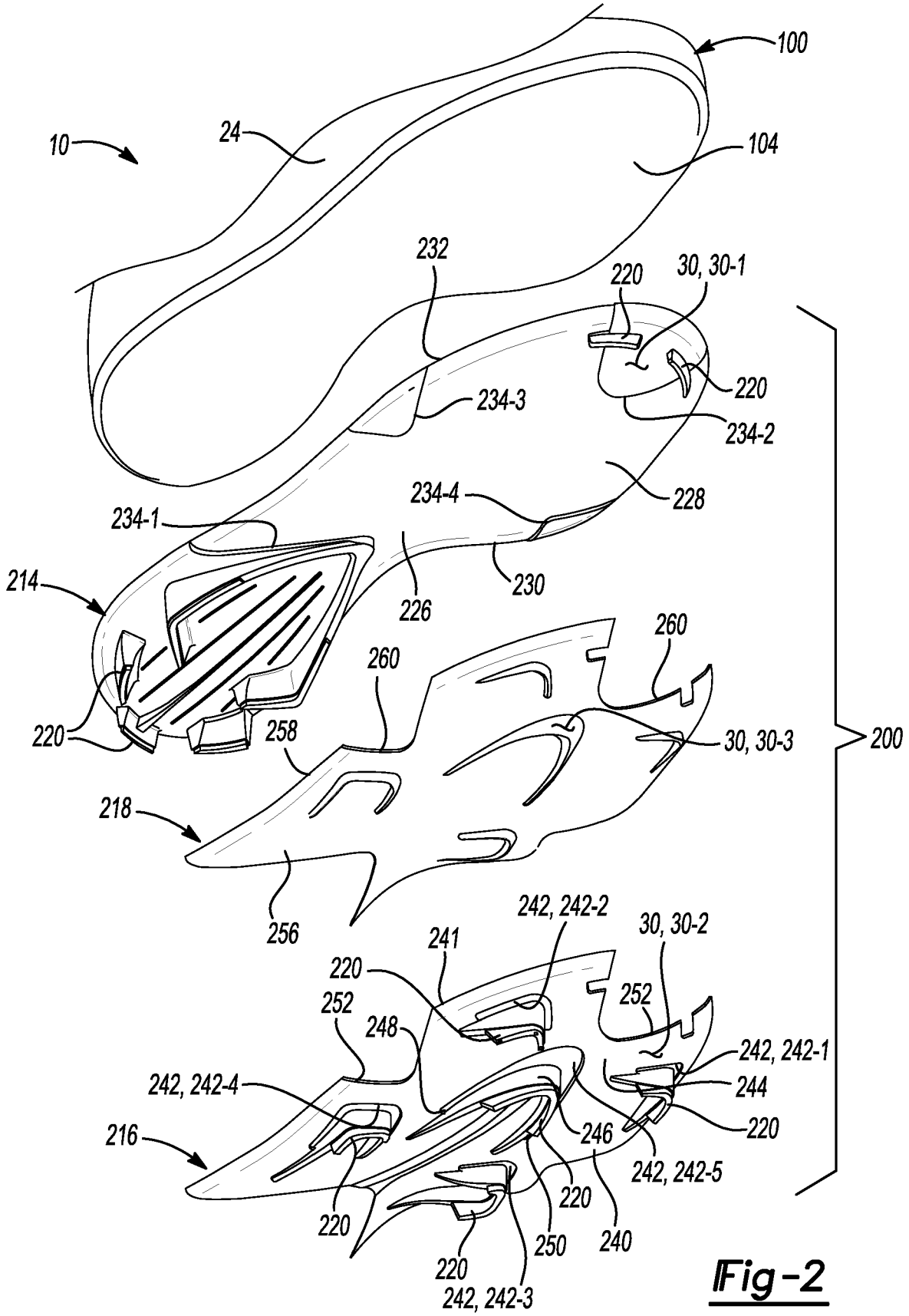
FIG. 2 is an exploded view of the article of footwear of FIG. 1.

Referring to FIGS. 1 and 2, an article of footwear 10 includes an upper 100 and sole structure 200. The article of footwear 10 may be divided into one or more regions. The regions may include a forefoot region 12, a mid-foot region 14, and a heel region 16. The forefoot region 12 may be subdivided into a toe portion 12T corresponding with phalanges and a ball portion 12B associated with metatarsal bones of a foot. The mid-foot region 14 may correspond with an arch area of the foot, and the heel region 16 may correspond with rear portions of the foot, including a calcaneus bone.

Figure 3:
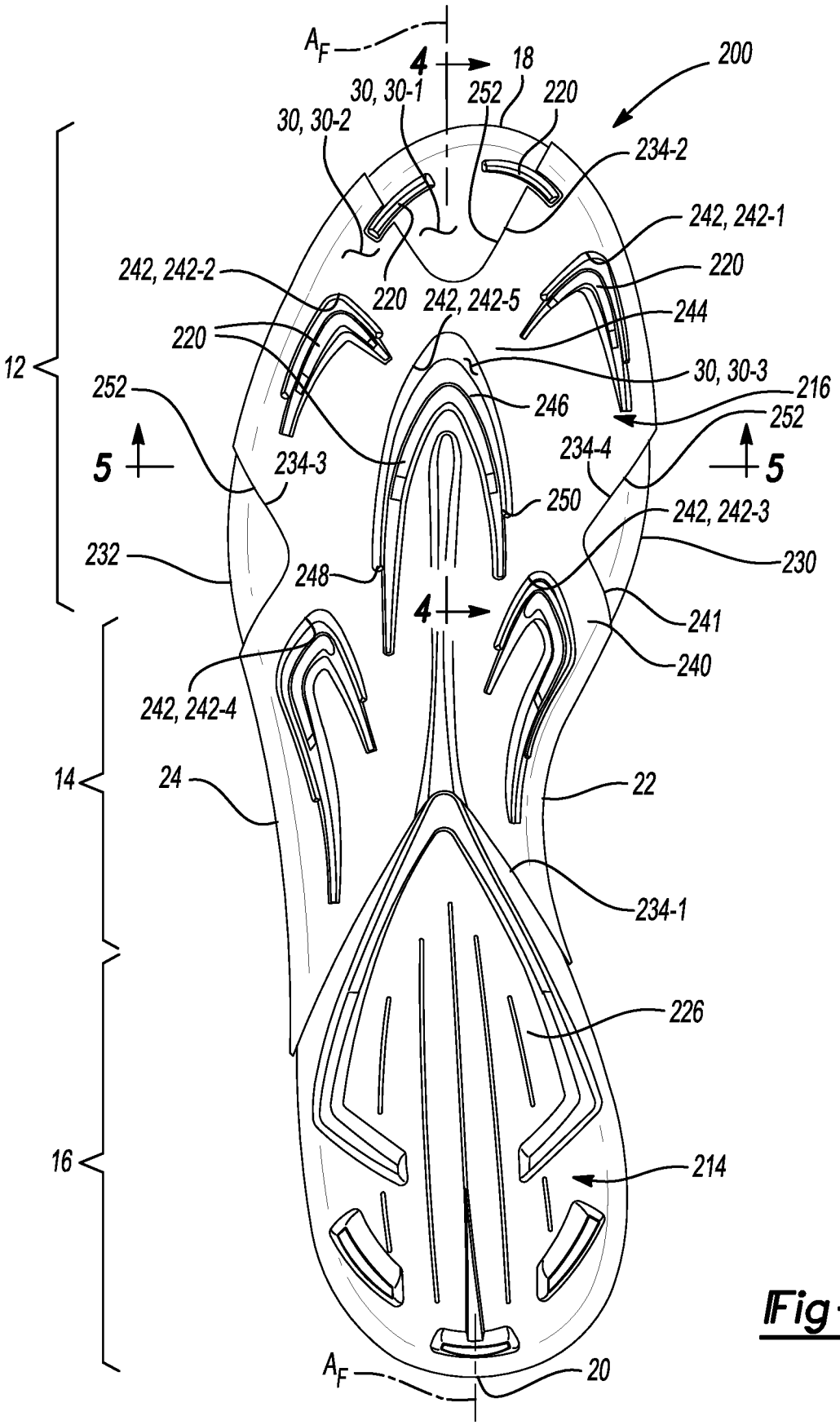
FIG. 3 is a bottom view of the article of footwear of FIG. 1.
Figure 4:
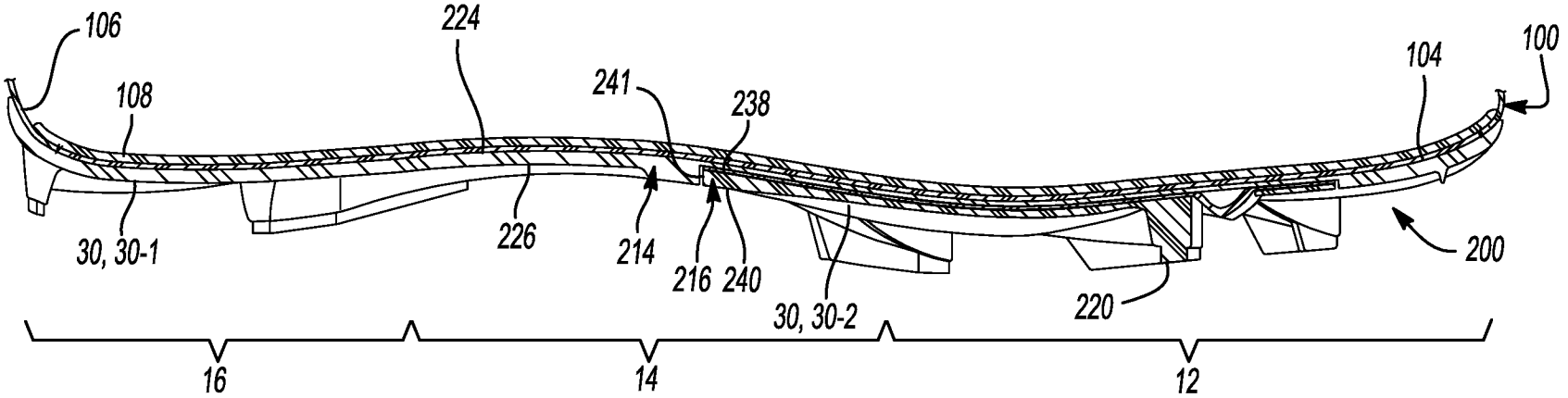
FIG. 4 is a cross-sectional view of a sole structure of the article of footwear of FIG. 1, taken along the line 4-4 of FIG. 3 and corresponding to a longitudinal axis of the article of footwear.
Figure 5:
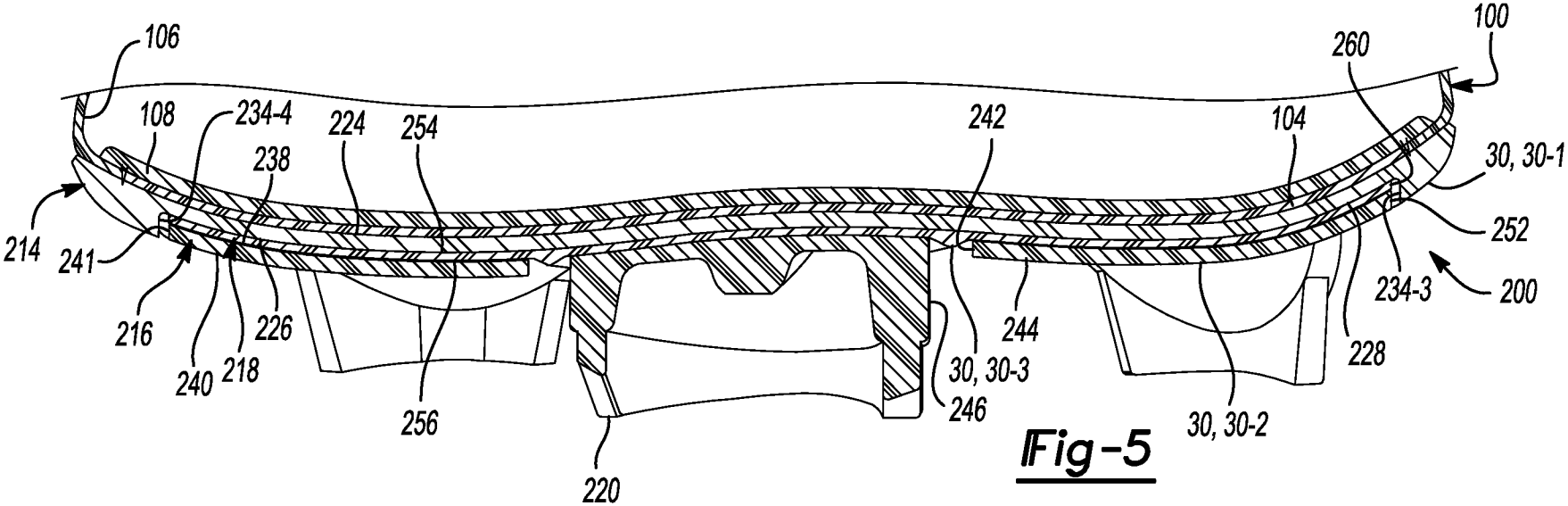
FIG. 5 is a cross-sectional view of the sole structure of the article of footwear of FIG. 1, taken along the line 5-5 of FIG. 3.

The footwear 10 may further include an anterior end 18 associated with a forward-most point of the forefoot region 12, and a posterior end 20 corresponding to a rearward-most point of the heel region 16. As shown in FIGS. 1 and 3, a longitudinal axis $A_F$ of the footwear 10 extends along a length of the footwear 10 from the anterior end 18 to the posterior end 20 parallel to a ground surface, and generally divides the footwear 10 into a medial side 22 and a lateral side 24. Accordingly, the medial side 22 and the lateral side 24 respectively correspond with opposite sides of the footwear 10 and extend through the regions 12, 14, 16. As used herein, a longitudinal direction refers to the direction extending from the anterior end 18 to the posterior end 20, while a lateral direction refers to the direction transverse to the longitudinal direction and extending from the medial side 22 to the lateral side 24.

As illustrated in FIG. 1, the upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

With reference to FIGS. 2 and 4-6B, in some examples, the upper 100 includes a strobel 104 having a bottom surface opposing the sole structure 200 and an opposing top surface defining a footbed 106 (FIG. 4-6B) of the interior void 102. Stitching or adhesives may secure the strobel to the upper 100. The footbed 106 may be contoured to conform to a profile of the bottom surface (e.g., plantar) of the foot. Optionally, the upper 100 may also incorporate additional layers such as an insole 108 or sockliner that may be disposed upon the strobel 104 and reside within the interior void 102 of the upper 100 to receive a plantar surface of the foot to enhance the comfort of the article of footwear 10. An ankle opening 114 (FIG. 1) in the heel region 16 may provide access to the interior void 102. For example, the ankle opening 114 may receive a foot to secure the foot within the void 102 and to facilitate entry and removal of the foot from and to the interior void 102.

As illustrated in FIG. 1, in some examples, one or more fasteners 110 extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners 110. The fasteners 110 may include laces, straps, cords, hook-and-loop, or any other suitable type of fastener. The upper 100 may include a tongue portion 116 that extends between the interior void 102 and the fasteners.

Referring to FIG. 2, the sole structure 200 may include one or more layers defining a ground-engaging surface 30 of the article of footwear 10. For example, the sole structure 200 may include an upper sole plate 214, a lower sole plate 216, a membrane 218, and a plurality of traction elements 220.

With reference to FIGS. 4-6B, the upper sole plate 214 may include an upper side 224 and a lower side 226 opposite the upper side 224. As illustrated in FIG. 2, the lower side 226 may define a first portion 30-1 of the ground-engaging surface 30 and may further include a recess 228 extending from a medial side 230 of the upper sole plate 214 to a lateral side 232 of the upper sole plate 214. The recess 228 may be defined in part by a plurality of sidewalls 234-1, 234-2, . . . **234-*n* extending transversely from the lower side 226 of the upper sole plate 214. For example, the recess 228 may be defined in part by a rearward sidewall 234-1, a forward sidewall 234-2, a lateral sidewall 234-3, and a medial sidewall 234-4. Each of the sidewalls 234-1, 234-2, . . . 234-*n* may extend around respective portions of the ground-engaging surface 30. The rearward sidewall 234-1 may face the forward sidewall 234-2, while the lateral sidewall 234-3 may face the medial sidewall 234-4. In the illustrated example, the rearward and forward sidewalls 234-1, 234-2 extend from the medial side 230 of the upper sole plate 214 to the lateral side 232 of the upper sole plate 214, while the lateral sidewall 234-3 extends from a forward location on the lateral side 232 to a rearward location on the lateral side 232, and the medial sidewall 234-4 extends from a forward location on the medial side 230 to a rearward location on the medial side 230. Accordingly, the recess 228 may be disposed between, and defined by, the rearward sidewall 234-1, the forward sidewall 234-2, the lateral sidewall 234-3, and the medial sidewall 234-4**.

A plurality of the traction elements 220 may extend from the first portion 30-1 of the ground-engaging surface 30. In the illustrated example, a plurality of the traction elements 220 are disposed partially on the first portion 30-1 of the ground-engaging surface 30 and partially within the recess 228. In this regard, in some implementations, a sidewall of one or more of the traction elements 220 defines a portion of the sidewalls 234-1, 234-2, . . . **234-*n***.

The upper sole plate 214, including the traction elements 220 disposed thereon, generally provides abrasion-resistance and traction with a ground surface (FIGS. 6A and 6B) during use of the article of footwear 10, and may be formed from one or more materials that impart durability, wear-resistance, rigidity, or stiffness, as well as enhance traction with the ground surface 300. For example, the upper sole plate 214 may be at least partially formed of a first material having a high stiffness or high modulus of elasticity. For example, nylon, plastic, and/or carbon fiber may form at least a portion of the upper sole plate 214 or the traction elements 220 disposed thereon.

Referring to FIGS. 4-6B, the lower sole plate 216 may include an upper side 238, a lower side 240 formed on an opposite side of the lower sole plate 216 from the upper side 238, and a peripheral edge 241 extending around the upper and lower sides 238, 240. The lower side 240 may define a second portion 30-2 of the ground-engaging surface 30 of the sole structure 200 and may further define a plurality of apertures 242. In some implementations, the apertures 242 define a recess formed in the second portion 30-2 of the ground-engaging surface 30. In other implementations, the apertures 242 define a through-hole extending through both the upper and lower sides 238, 240 of the lower sole plate 216. The apertures 242 may be disposed in various locations, and define various sizes and shapes. For example, as illustrated in FIGS. 2 and 3, in some implementations, the apertures 242 include a medial forefoot aperture 242-1, a lateral forefoot aperture 242-2, a medial mid-foot aperture 242-3, a lateral mid-foot aperture 242-4, and a central aperture 242-5. It will be appreciated, however, that the lower sole plate 216 may include more or less than five apertures 242 disposed in various other locations within the scope of the present disclosure.

In some implementations, the apertures 242 separate a first ground-engaging portion 244 of the lower sole plate 216 from a second ground-engaging portion 246 of the lower sole plate 216. In some implementations, each of the apertures 242 defines an arcuate slot extending from a proximal end 248 to a distal end 250. In the illustrated example, the proximal and distal ends 248, 250 are disposed rearward of an intermediate portion of the slot or aperture 242. In some implementations, the apertures 242 define a U-shaped or V-shaped slot, such that each aperture 242 extends around the second ground-engaging portion 246 of the lower sole plate 216. In this regard, the second ground-engaging portion 246 of the lower sole plate 216 may be cantilevered relative to the first ground-engaging portion 244 of the lower sole plate 216, such that the second ground-engaging portion 246 is disposed within one of the apertures 242. Accordingly, as will be explained in more detail below, in order to improve traction between the lower sole plate 216 and the ground surface during use, the second ground-engaging portion 246 of the lower sole plate 216 may remain stationary, or otherwise maintain a constant orientation relative to the ground surface, while the first ground-engaging portion 244 of the lower sole plate 216 flexes and moves relative to both the second ground-engaging portion 246 and the ground surface 300. In particular, as illustrated in FIGS. 2 and 3, at least one of the traction elements 220 may be disposed on, and extend from, one of the second ground-engaging portions 246 of the lower sole plate 216 such that, during use, the traction element 220 remains stationary, or otherwise maintains a constant orientation relative to the ground surface, while the first ground-engaging portion 244 of the lower sole plate 216 flexes and moves relative to both the traction element 220 and the ground surface.

The peripheral edge 241 may define a plurality of notches 252 having sizes, shapes, and locations generally corresponding to a size, shape, and location of a respective sidewall of the sidewalls 234-1, 234-2, . . . **234-*n***.

The lower sole plate 216, including the traction elements 220 disposed thereon, generally provides abrasion-resistance and traction with the ground surface 300 during use of the article of footwear 10, and may be formed from one or more materials that impart durability, wear-resistance, rigidity, or stiffness, as well as enhance traction with the ground surface. For example, the lower sole plate 216 may include a second material having a high stiffness or high modulus of elasticity. For example, nylon, plastic, and/or carbon fiber may form at least a portion of the lower sole plate 216 or the traction elements 220 disposed thereon. In some implementations, the upper and lower sole plates 214, 216 are formed at least in part from the same material.

The membrane 218 may include an upper side 254, a lower side 256 formed on an opposite side of the membrane 218 from the upper side 254, and a peripheral edge 258 extending around the upper and lower sides 254, 256. The lower side 256 may define third portions 30-3 of the ground-engaging surface 30 of the sole structure 200. In this regard, the third portions 30-3 may protrude from the lower side 256 of the membrane 218. In some implementations, the third portions 30-3 define U-shaped or V-shaped protrusions. For example, the size, shape, and location of each third portion 30-3 may generally correspond to, or match, the size, shape, and location of a respective aperture of the apertures 242 formed in the lower sole plate 216. Similarly, the peripheral edge 258 may define a plurality of notches 260 having sizes, shapes, and locations generally corresponding to a size, shape, and location of a respective sidewall of the sidewalls 234-1, 234-2, . . . **234-*n*. In particular, the size and shape of the membrane 218, including the peripheral edge 258, may generally correspond to, or be the same as, the size and shape of the lower sole plate 216, including the peripheral edge 241**.

The membrane 218, including the third portions 30-3 protruding from the lower side 256, generally provides resilient flexibility during use of the article of footwear 10, and may be formed from one or more materials that impart flexibility and elasticity. For example, the membrane 218 may include a material having a low stiffness, low durometer, and/or low modulus of elasticity. In particular, the membrane 218 may be formed at least partially of rubber or another elastomeric material having a stiffness that is less than the stiffness of the upper or lower sole plates 214, 216. In some implementations, the membrane 218 forms a gasket between the upper and lower sole plates 214, 216. Accordingly, the membrane 218 may be referred to herein as a "gasket 218."

As shown in FIGS. 4-6B, when the sole structure 200 is assembled, the upper side 224 of the upper sole plate 214 may receive the upper 100 (e.g., strobel 104), and the lower side 226 of the upper sole plate 214 may receive the membrane 218 and/or the lower sole plate 216. In particular, the membrane 218 and the lower sole plate 216 may be disposed within the recess 228 such that the lower side 226 of the upper sole plate 214 engages the upper side 254 of the membrane 218. Each sidewall 234-1, 234-2, . . . **234-*n* of the upper sole plate 214 may be disposed within a notch 252, 260 of the lower sole plate 216 and the membrane 218, respectively. In some implementations, the sidewalls 234-1, 234-2, . . . 234-*n* of the upper sole plate 214 may engage the peripheral edges 241, 258 of the lower sole plate 216 and the membrane 218**, respectively.

The lower side 256 of the membrane 218 may engage the upper side 238 of the lower sole plate 216. In some implementations, the lower side 256 of the membrane 218 is bonded to the upper side 238 of the lower sole plate 216. For example, the lower side 256 of the membrane 218 may be bonded to the upper side 238 of the lower sole plate 216 using an adhesive, an overmold process, or other suitable technique.

Each protruding third portion 30-3 of the membrane 218 may be disposed within one of the apertures 242. For example, each protruding third portion 30-3 may be disposed within one of the apertures 242 such that the membrane 218 sealingly engages the first and second portions 244, 246 of the lower sole plate 216 to prevent dirt, water, and other debris from entering the sole structure 200, between the upper and lower sole plates 214, 216, from the ground surface. In particular, each protruding third portion 30-3 may be disposed within one of the apertures 242 such that the membrane 218 is bonded to the first and second ground-engaging portions 244, 246 of the lower sole plate 216.

As will be explained in more detail below, during use, the membrane 218, including the protruding third portions 30-3, may flex and move relative to the first ground-engaging portion 244 or the second ground-engaging portion 246 of the lower sole plate 216, while the first ground-engaging portion 244 of the lower sole plate 216 flexes and moves relative to both the second ground-engaging portion 246 of the lower sole plate 216 and the ground surface 300. In particular, as the first ground-engaging portion 244 of the lower sole plate 216 flexes and moves relative to both the second ground-engaging portion 246 and the ground surface 300, the second ground-engaging portion 246, including the traction elements 220 thereon, may remain stationary, or otherwise maintain a constant orientation, relative to the ground surface 300, in order to improve traction between the lower sole plate 216 and the ground surface while improving the comfort and feel of sole structure 200 relative to the user's foot.

Figure 6A:
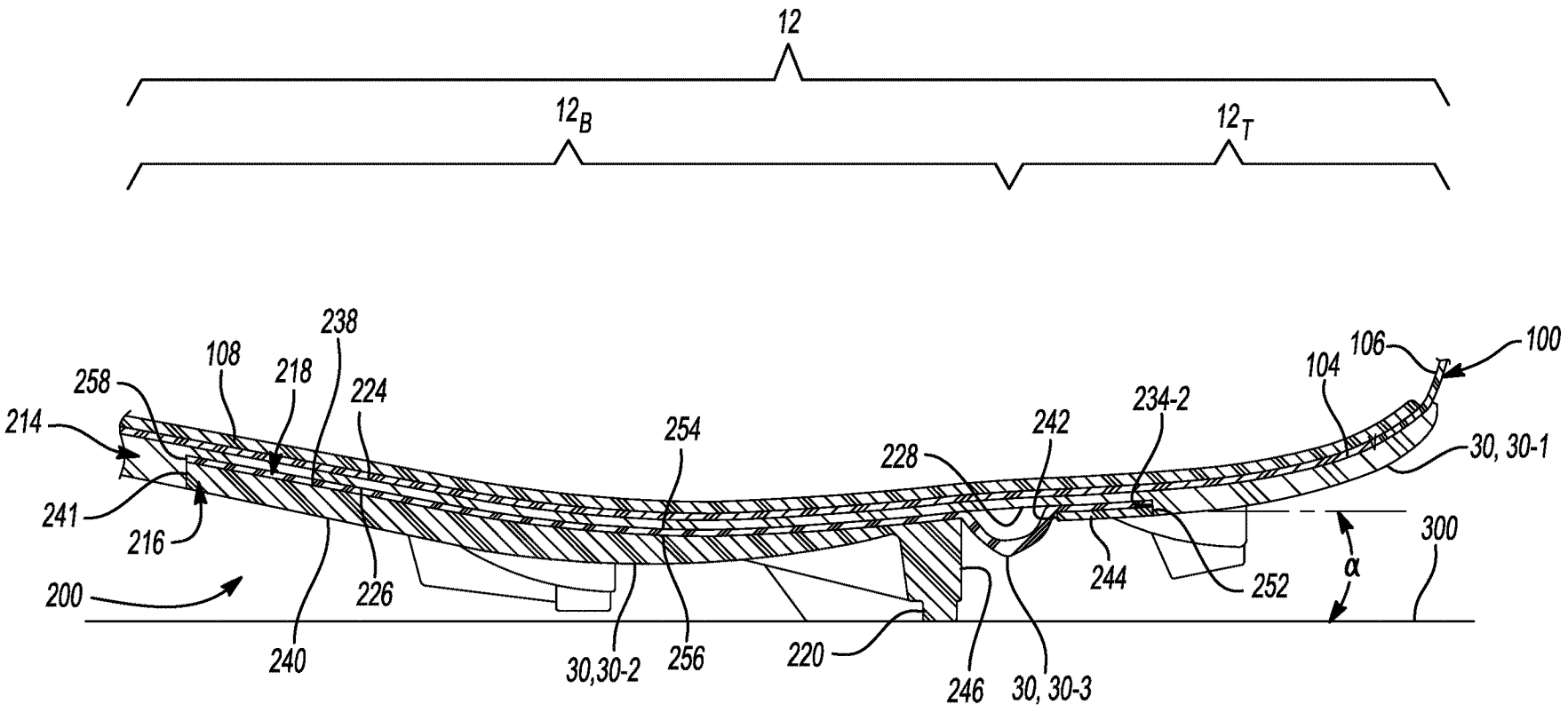
FIG. 6A is a cross-sectional view of a forefoot portion of the sole structure of the article of footwear of FIG. 1, taken along the line 4-4 of FIG. 3, the sole structure shown in a first orientation relative to a ground surface.
Figure 6B:
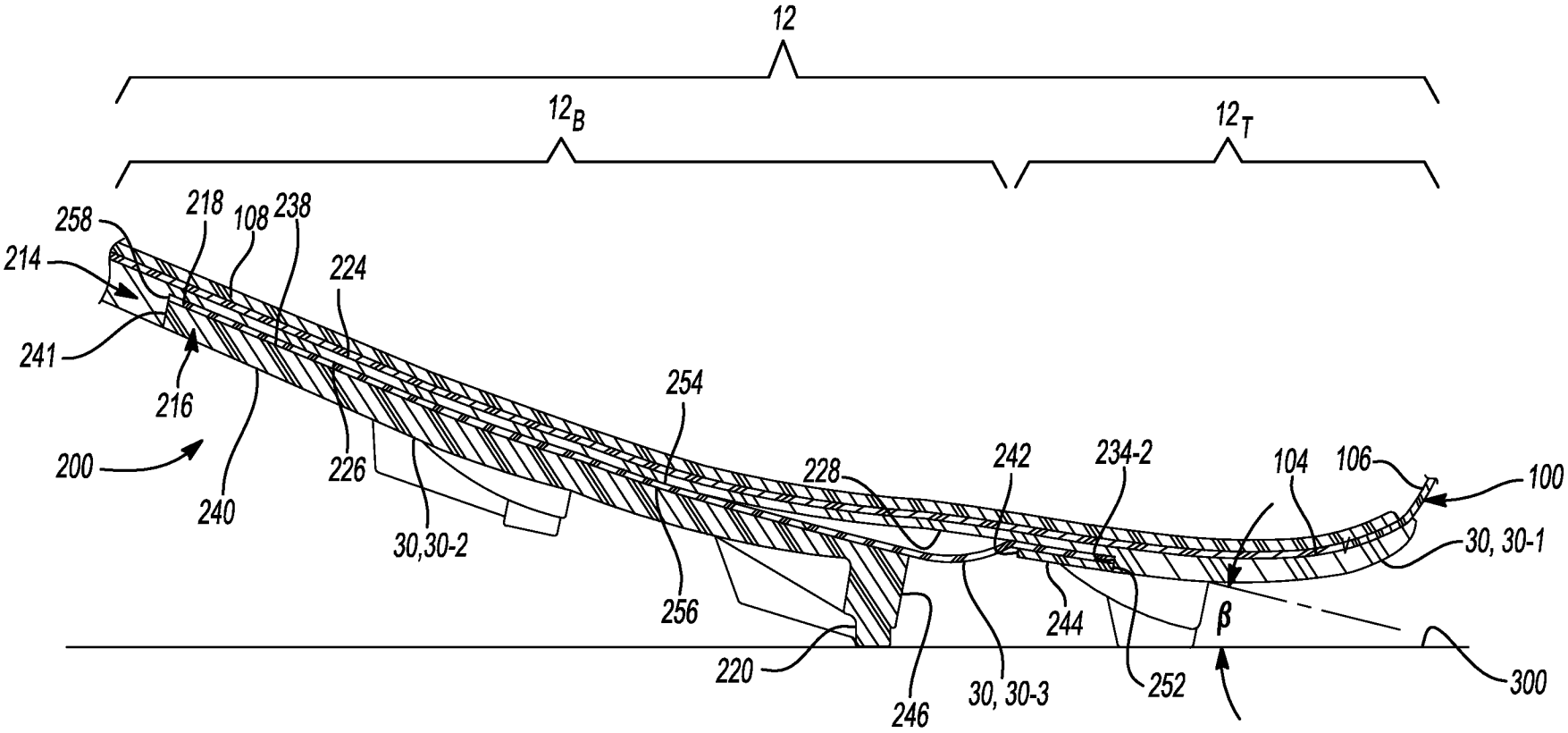
FIG. 6B is a cross-sectional view of the forefoot portion of the sole structure of the article of footwear of FIG. 1, taken along the line 4-4 of FIG. 3, the sole structure shown in a second orientation relative to the ground surface.
Figure 7:
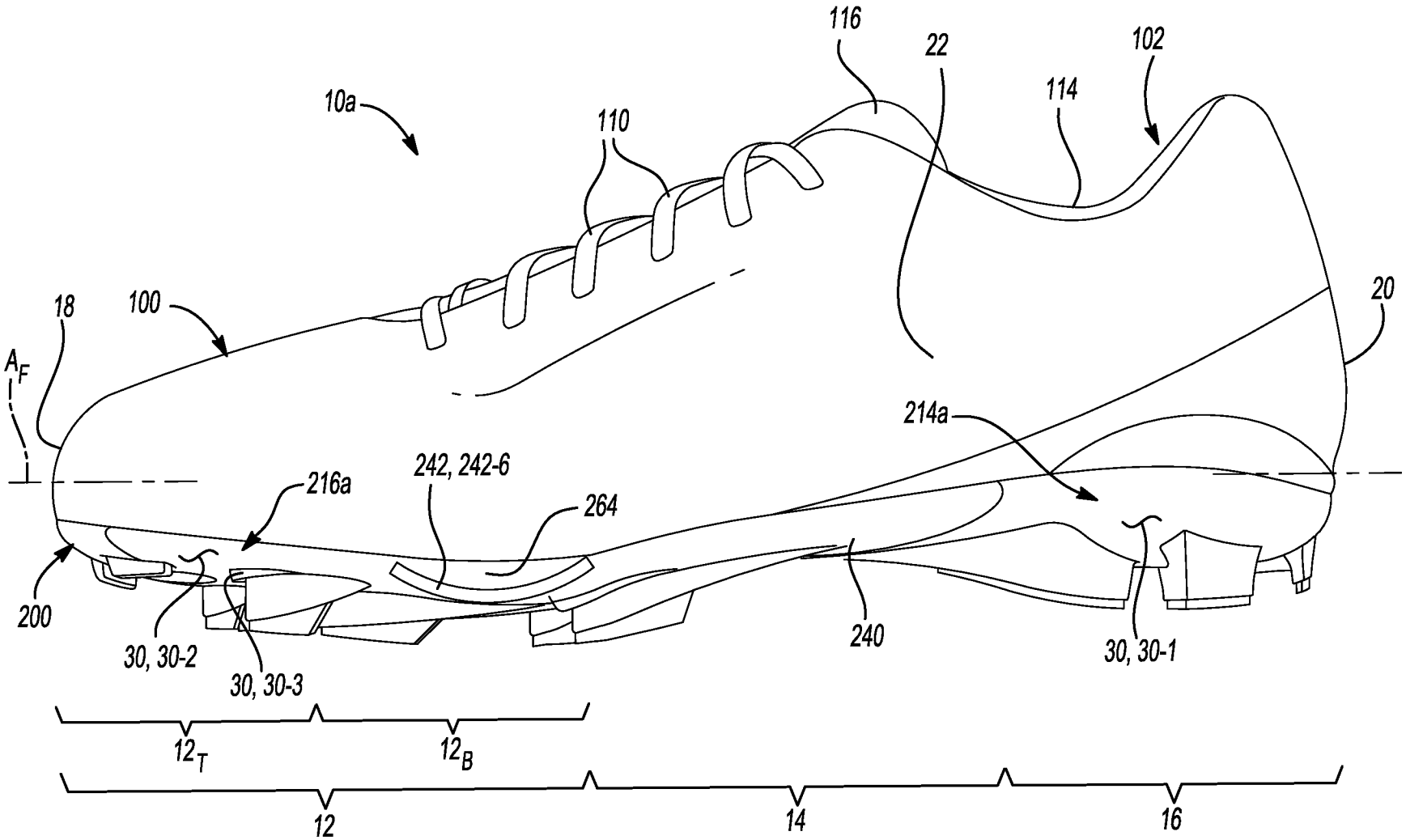
FIG. 7 is a side elevation view of another article of footwear in accordance with the principles of the present disclosure.

With reference to FIGS. 6A and 6B, a method of using the sole structure 200 to provide increased traction and shock absorption in the forefoot and mid-foot regions 12, 14 of the footwear 10 will be described. As illustrated, the first and second ground-engaging portions 244, 246 may be disposed a first distance from the anterior end 18 of the article of footwear 10. Referring to FIG. 6A, in a first configuration (e.g., resting or footwear disengaged from the ground surface 300), the first ground-engaging portion 244 may define a first angle α or orientation relative to the ground surface 300 at the first distance from the anterior end 18 of the article of footwear 10, while the second ground-engaging portion 246 is in a first orientation.

As illustrated in FIG. 6B, as the foot rolls forward to the forefoot region 12, the first ground-engaging portion 244 of the lower sole plate 216 may move away from the ground surface 300 with the user's foot, while the second ground-engaging portion 246 and traction elements 220 of the lower sole plate 216 flex relative to the first ground-engaging portion 244 and remain engaged with, or stationary relative to, the ground surface 300. In this regard, the second ground-engaging portion 246 may rotate relative to the first ground-engaging portion 244, such that the first ground-engaging portion 244 defines a second angle β or orientation relative to the ground surface 300 at the first distance from the anterior end 18 of the article of footwear 10, while the second ground-engaging portion 246 maintains the first orientation. The second angle β may be different (e.g., greater than) the first angle α.

Accordingly, during engagement of the lower sole plate 216 with the ground surface 300, the sole structure 200 is configured to provide increased traction and shock absorption in the forefoot and mid-foot regions 12, 14 by allowing the traction elements 220 and the second ground-engaging portion 246 of the lower sole plate 216 to maintain engagement with the ground surface 300 for a longer period of time than an area (e.g., the first ground-engaging portion 244) of the lower sole plate 216 extending around, and immediately adjacent to, the second ground-engaging portion 246 of the plate.

Referring now to FIGS. 7-11B, another article of footwear 10*a* is provided and includes the upper 100 and a sole structure 200*a* attached to the upper 100. In view of the substantial similarity in structure and function of the components associated with the article of footwear 10*a* with respect to the article of footwear 10, like reference numerals are used hereinafter and in the drawings to identify like components while like reference numerals containing letter extensions are used to identify those components that have been modified.

Figure 8:
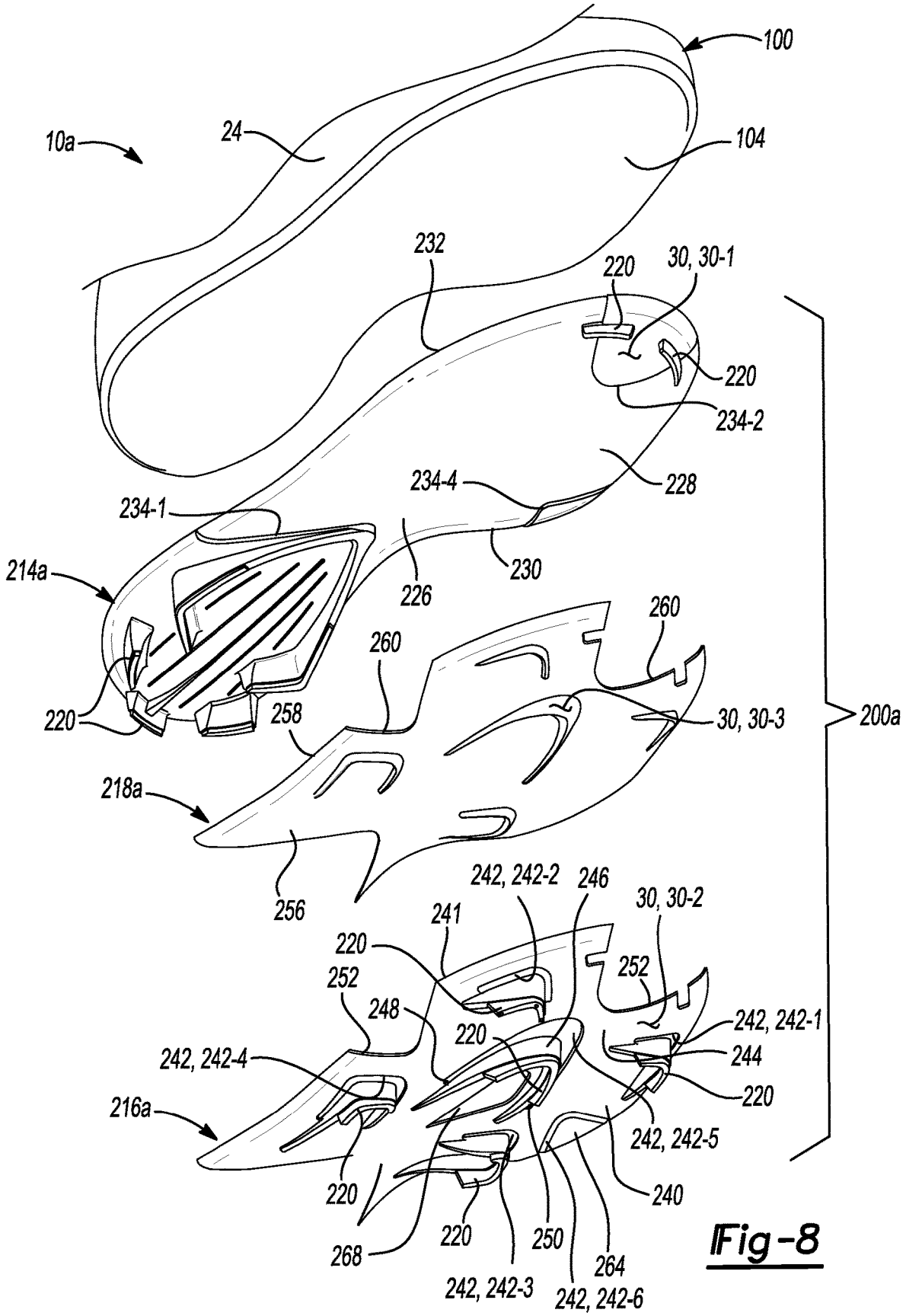
FIG. 8 is an exploded view of the article of footwear of FIG. 7.
Figure 10:
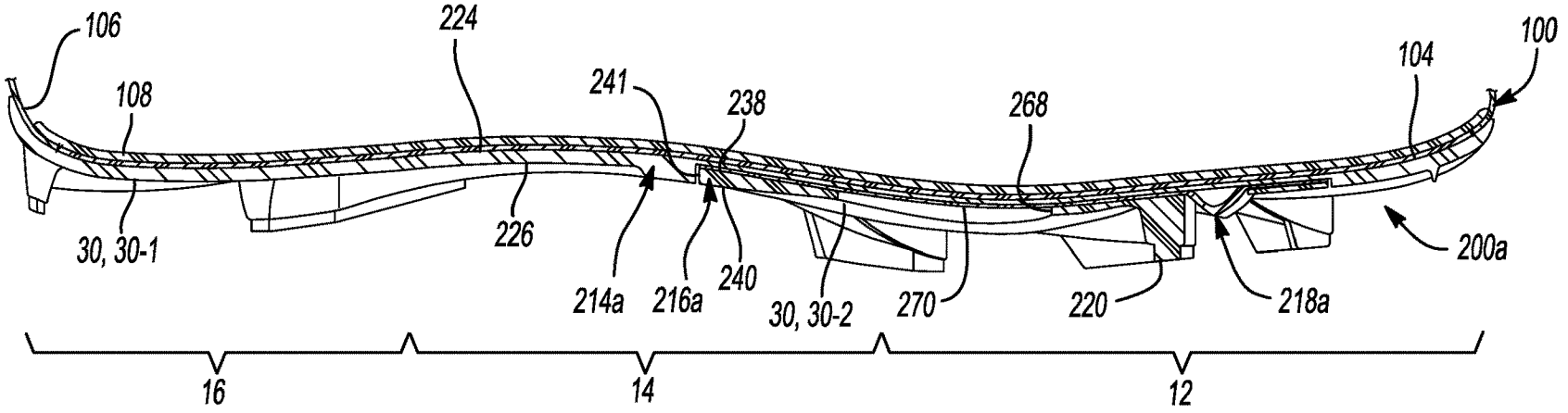
FIG. 10 is a cross-sectional view of a sole structure of the article of footwear of FIG. 7, taken along the line 10-10 of FIG. 9 and corresponding to a longitudinal axis of the article of footwear.
Figure 11B:
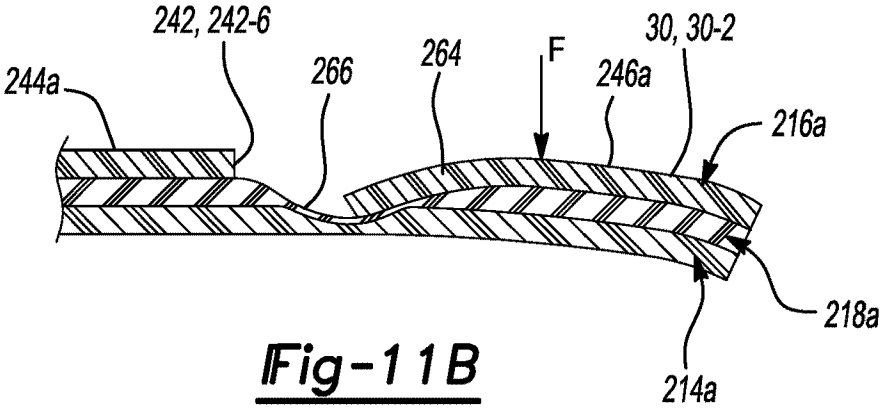
FIG. 11B is a fragmentary, cross-sectional view of the forefoot portion of the sole structure of the article of footwear of FIG. 7, taken along the line 11-11 of FIG. 9, the sole structure shown in a second orientation

As illustrated in FIG. 8, the sole structure 200*a* may include an upper sole plate 214*a*, a lower sole plate 216*a*, a membrane 218*a*, and one or more of the traction elements 220. Referring to FIGS. 10-11B, the lower sole plate 216*a* may include the upper side 238, the lower side 240 opposite the upper side 238, and the peripheral edge 241 extending around the upper and lower sides 238, 240. The lower side 240 may define a second portion 30-2 of the ground-engaging surface 30 of the sole structure 200*a* and may further define a plurality of the apertures 242.

As shown in FIG. 10, when the sole structure 200*a* is assembled, the upper side 224 of the upper sole plate 214*a* may receive the upper 100 (e.g., strobel 104), and the lower side 226 of the upper sole plate 214*a* may receive the membrane 218*a* and/or the lower sole plate 216*a*. In particular, the membrane 218*a* and the lower sole plate 216*a* may be disposed within the recess 228*a* such that the lower side 226 of the upper sole plate 214*a* engages the upper side 254 of the membrane 218*a*.

The lower side 256 of the membrane 218*a* may engage the upper side 238 of the lower sole plate 216*a*. In some implementations, the lower side 256 of the membrane 218*a* is bonded to the upper side 238 of the lower sole plate 216*a*. For example, the lower side 256 of the membrane 218*a* may be bonded to the upper side 238 of the lower sole plate 216*a* using an adhesive, an overmold process, or other suitable technique.

Figure 9:
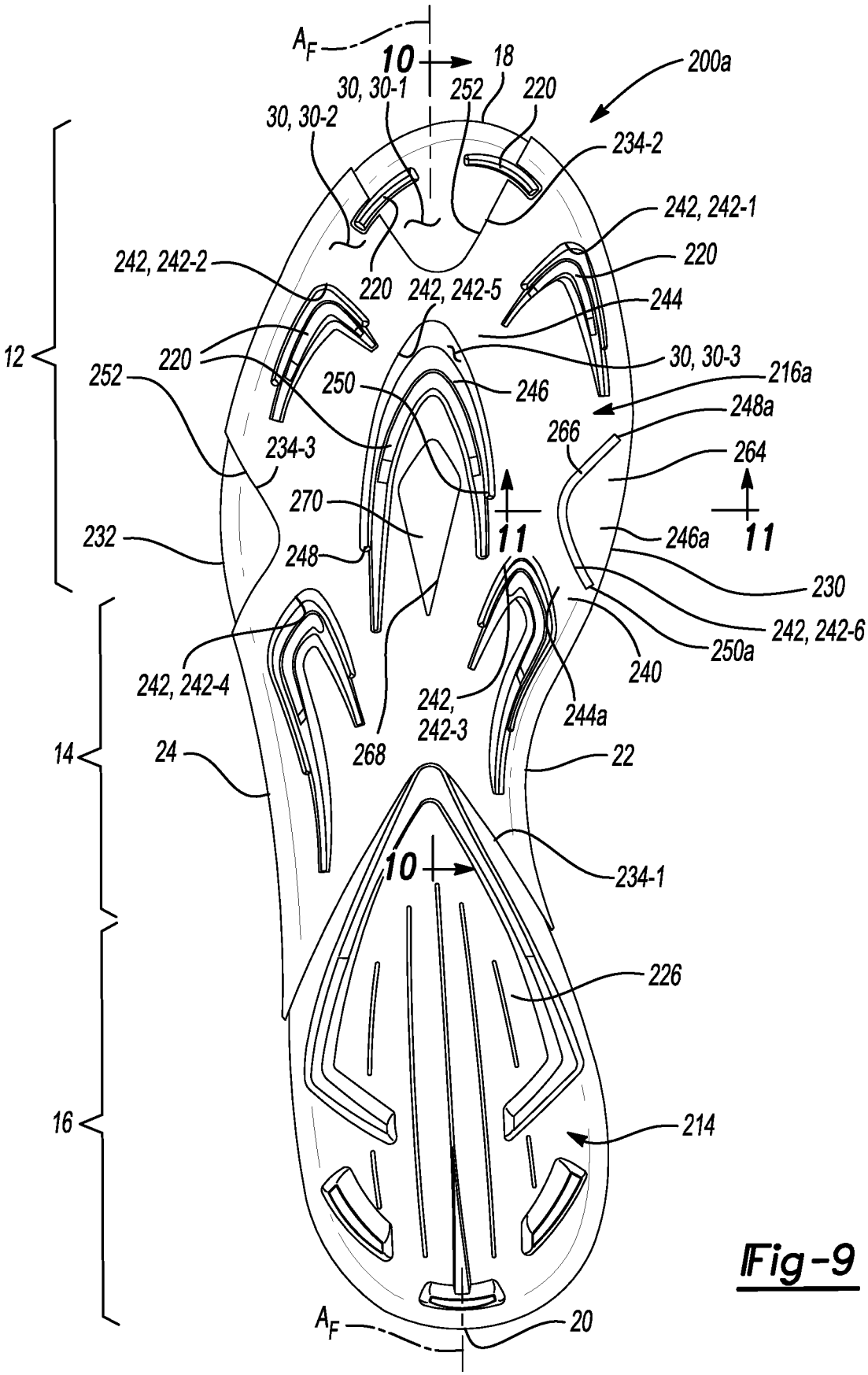
FIG. 9 is a bottom view of the article of footwear of FIG. 7.

In some implementations, each of the apertures 242 defines a through-hole extending through both the upper and lower sides 238, 240 of the lower sole plate 216*a*. The apertures 242 may be disposed in various locations, and define various sizes and shapes. For example, as illustrated in FIGS. 8 and 9, it will be appreciated that the lower sole plate 216*a* may include one or more of the apertures 242-1-242-5 discussed above with respect to the example of the article of footwear 10. Further, in some implementations the apertures 242 may include a medial ball aperture 242-6.

Referring to FIG. 9, the medial ball aperture 242-6 may separate a first ground-engaging portion 244*a* of the lower sole plate 216*a* from a second ground-engaging portion 246*a* of the lower sole plate 216*a*. In some implementations, the medial ball aperture 242-6 defines a slot extending from a proximal end 248*a* to a distal end 250*a*. In the illustrated example, the proximal and distal ends 248*a*, 250*a* are disposed laterally outwardly of a remaining portion of the medial ball aperture 242-6.

Figure 11A:
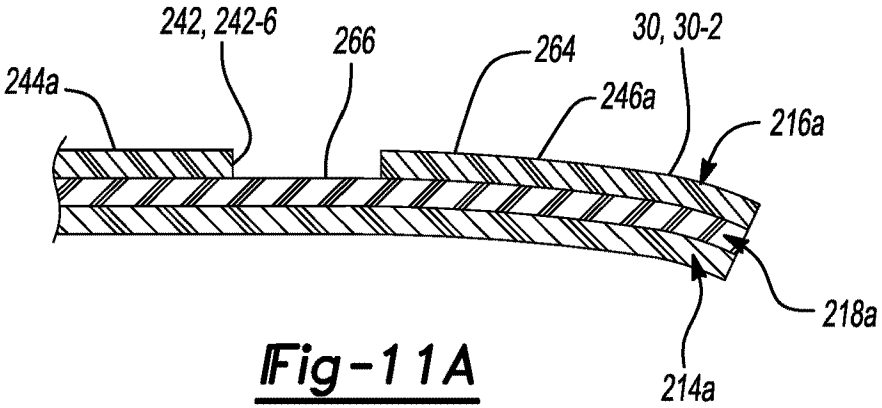
FIG. 11A is a fragmentary, cross-sectional view of a forefoot portion of the sole structure of the article of footwear of FIG. 7, taken along the line 11-11 of FIG. 9, the sole structure shown in a first orientation.
Figure 12:
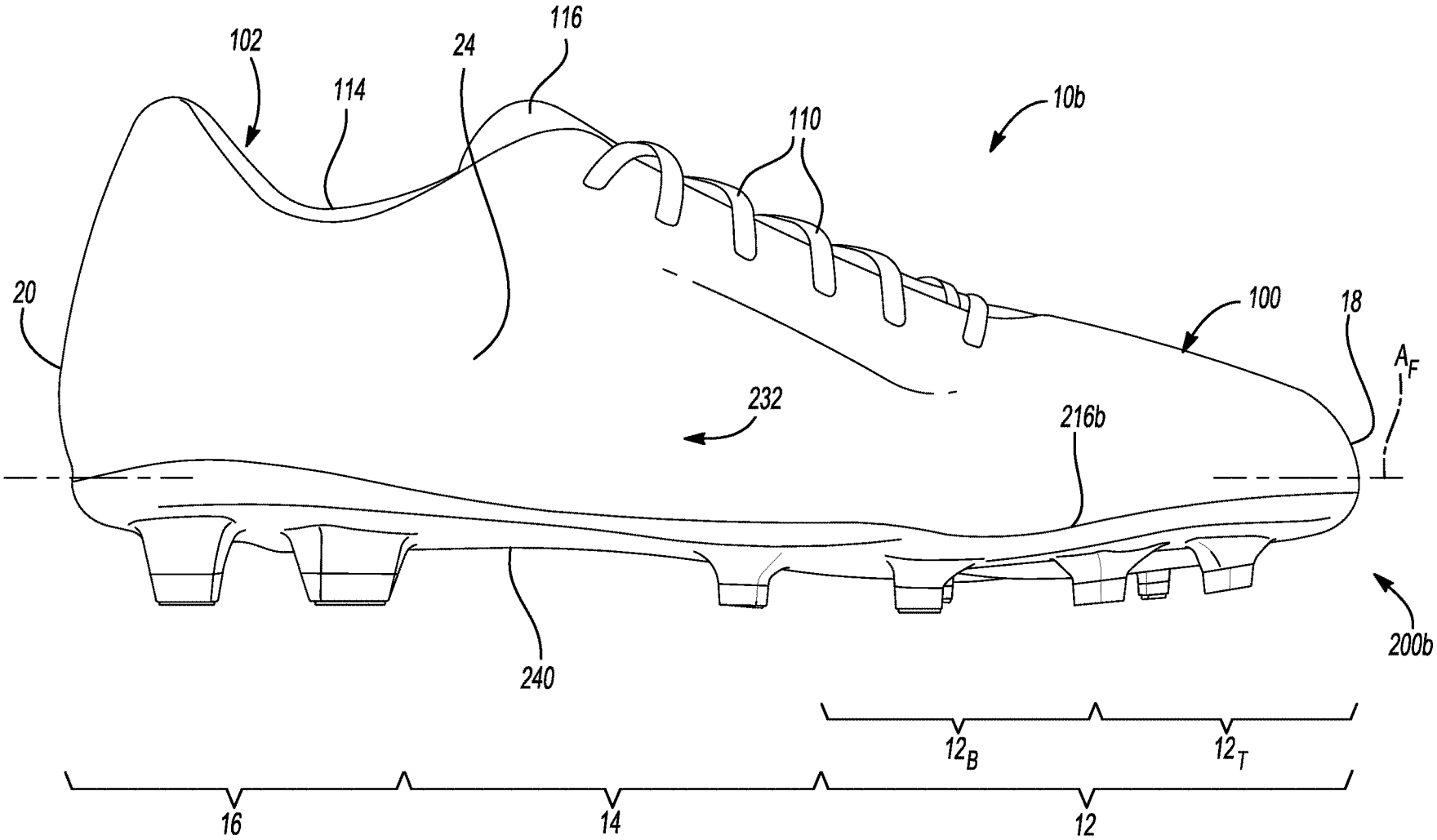
FIG. 12 is a side elevation view of another article of footwear in accordance with the principles of the present disclosure.

In some implementations, the medial ball aperture 242-6 defines a U-shaped or V-shaped slot, such that the medial ball aperture 242-6 extends around a ball control portion 264 of the lower sole plate 216*a*. In this regard, and as illustrated in FIGS. 11A and 11B, the ball control portion 264 of the lower sole plate 216*a* may be cantilevered relative to the first ground-engaging portion 244*a* of the lower sole plate 216*a* disposed along at least one of the medial or lateral sides 22, 24 of the article of footwear 10*a*. Accordingly, in order to improve a user's control of, and feel for, a ball (e.g., a soccer ball) upon contact with the second portion of the ground-engaging surface 30-2 defined by the ball control portion 264, the ball control portion 264 may flex, or otherwise assume a different orientation relative to the first ground-engaging portion 244*a*, upon contact with, and application of a force F by, the ball. By providing the ball control portion 264 with an enhanced degree of flexibility relative to the first ground-engaging portion 244*a*, the portion of the lower sole plate 216*a* including the ball control portion 264 may maintain contact with the ball for an extended period of time, thereby allowing the user to provide maximum influence to the direction of the ball.

As illustrated in FIGS. 9 and 11A-11B, a portion 266 of the lower side 256 of the membrane 218*a* may be exposed (e.g., visible) through the medial ball aperture 242-6 of the lower sole plate 216*a*. For example, the exposed portion 266 of the lower side 256 may be disposed within the medial ball aperture 242-6, such that the membrane 218*a* sealingly engages the first portion 244*a* and the second portion 246*a* of the lower sole plate 216*a* to prevent dirt, water, and other debris from entering the sole structure 200*a* (e.g., between the upper and lower sole plates 214*a*, 216*a*) through the medial ball aperture 242-6 from the ground surface. In particular, the exposed portion 266 of the lower side 256 may be disposed within the medial ball aperture 242-6 such that the membrane 218*a* is bonded to the first portion 244*a* and the second portion 246*a* of the lower sole plate 216*a*.

In addition to the apertures 242, the lower sole plate 216*a* may include one or more ball control openings 268 formed through a thickness of the lower sole plate 216*a*, which are each at least partially surrounded by corresponding ones of the traction elements 220 and apertures 242. For example, the illustrated lower sole plate 216*a* includes a central ball control opening 268 that is disposed in the forefoot region 12 and partially surrounded by the central aperture 242-5. As shown, the central ball control opening 268 has an elongate shape extending along the direction of the longitudinal axis $A_F$ of the article of footwear 10*a*. While the illustrated central ball control opening 268 has a diamond shape, in other examples, the central ball control opening 268 may have other shapes, such as polygonal, rounded (e.g., obround, oval, circular), or irregularly contoured.

The central ball control opening 268 is configured to expose a ball control portion 270 of the membrane 218*a*. Here, the membrane 218*a* may be at least partially formed of a material providing more favorable properties for gripping a ball than the lower sole plate 216*a*. For example, the ball control portion 270 of the membrane 218*a* may have a higher coefficient of friction or a lower durometer than the adjacent material of the lower sole plate 216*a*. Accordingly, when the ball control portion 270 engages a ball, the improved grip provided by the material of the membrane 218*a* allows the ball to be handled more securely.

The traction element 220 and/or the central aperture 242-5 define a U-shaped or V-shaped construct extending around at least a portion of the central ball control opening 268. In this regard, the traction element 220 may be cantilevered relative to the first ground-engaging portion 244 of the lower sole plate 216*a*. Accordingly, as discussed above with respect to the example of FIGS. 2 and 3, in order to improve traction between the lower sole plate 216*a* and the ground surface during use, the second ground-engaging portion 246 of the lower sole plate 216*a* may remain stationary, or otherwise maintain a constant orientation relative to the ground surface, while the first ground-engaging portion 244 of the lower sole plate 216*a* flexes and moves relative to both the second ground-engaging portion 246 and the ground surface 300.

Accordingly, during engagement of the lower sole plate 216*a* with the ground surface 300, the sole structure 200*a* is configured to provide increased traction and shock absorption in the forefoot and mid-foot regions 12, 14 by allowing the traction elements 220 and the second ground-engaging portion 246 of the lower sole plate 216*a* to maintain engagement with the ground surface 300 for a longer period of time than an area (e.g., the first ground-engaging portion 244) of the lower sole plate 216*a* extending around, and immediately adjacent to, the second ground-engaging portion 246 of the plate.

Referring now to FIGS. 12-17, another article of footwear 10*b* is provided and includes the upper 100 and a sole structure 200*b* attached to the upper 100. In view of the substantial similarity in structure and function of the components associated with the article of footwear 10*b* with respect to the article of footwear 10, like reference numerals are used hereinafter and in the drawings to identify like components while like reference numerals containing letter extensions are used to identify those components that have been modified.

Figure 13A:
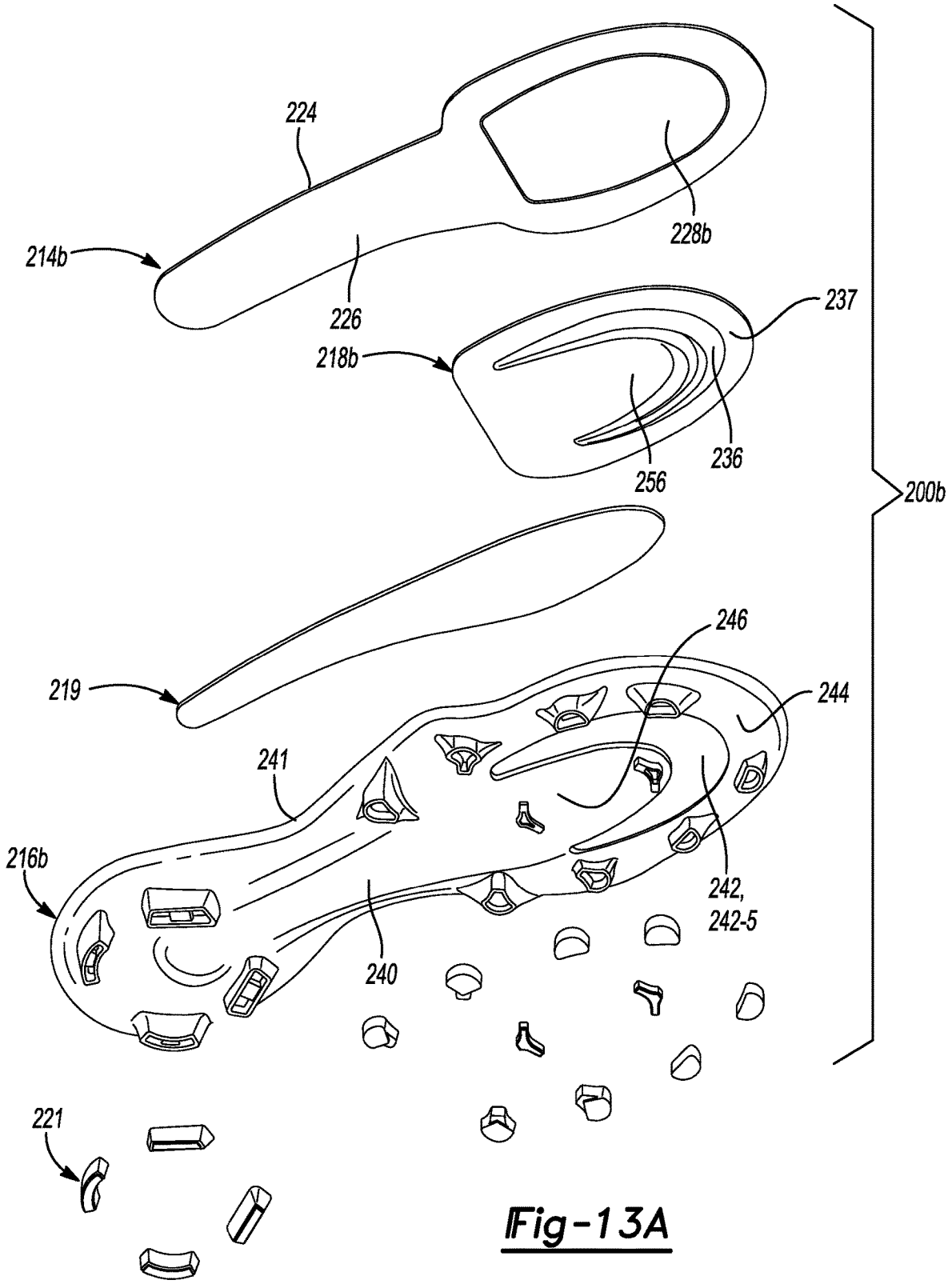
FIG. 13A is an bottom perspective exploded view of a sole structure of the article of footwear of FIG. 12.
Figure 13B:
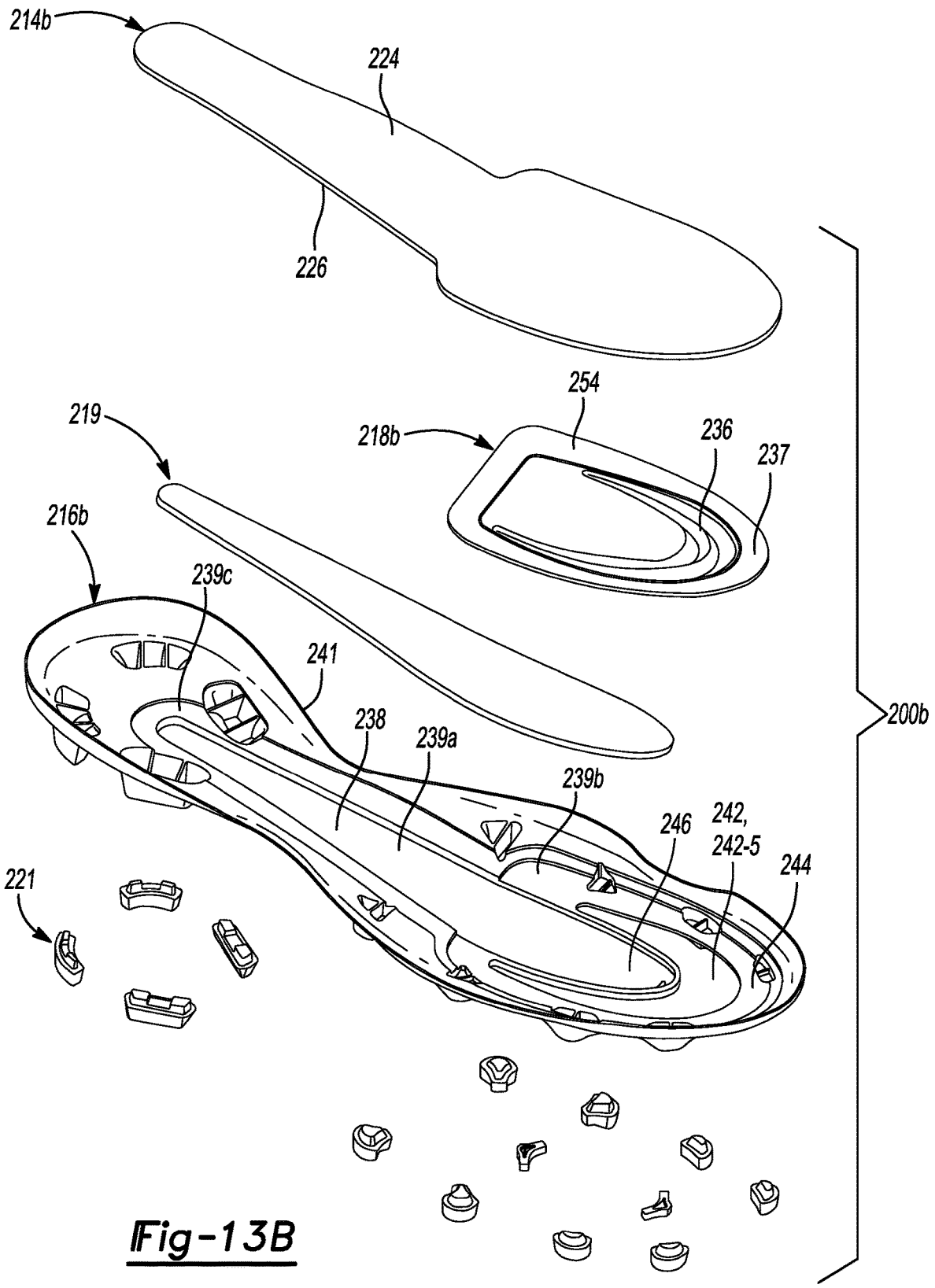
FIG. 13B is a top perspective exploded view of a sole structure of the article of footwear of FIG. 12.
Figure 14:
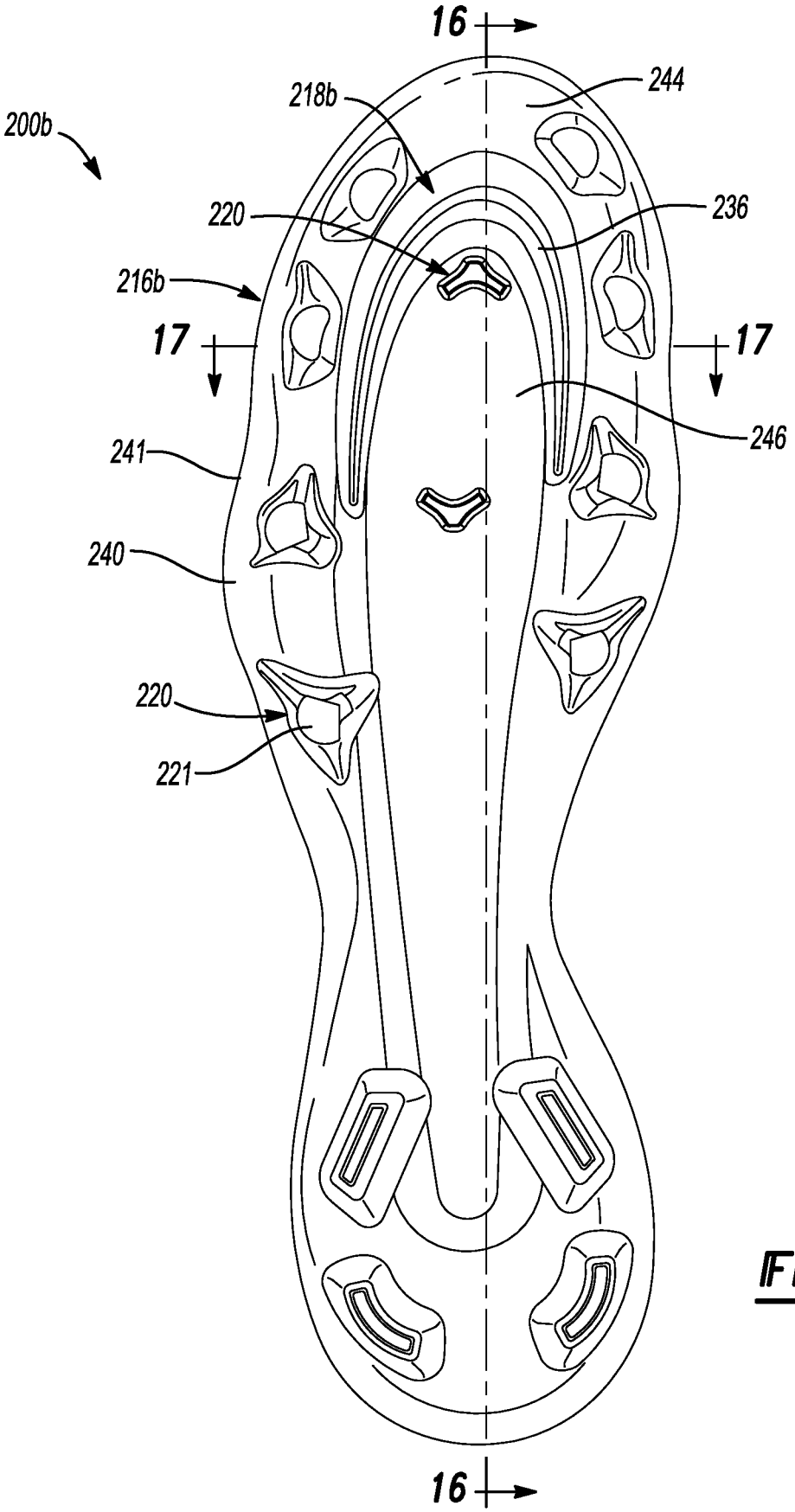
FIG. 14 is a bottom view of the article of footwear of FIG. 12.
Figure 15:
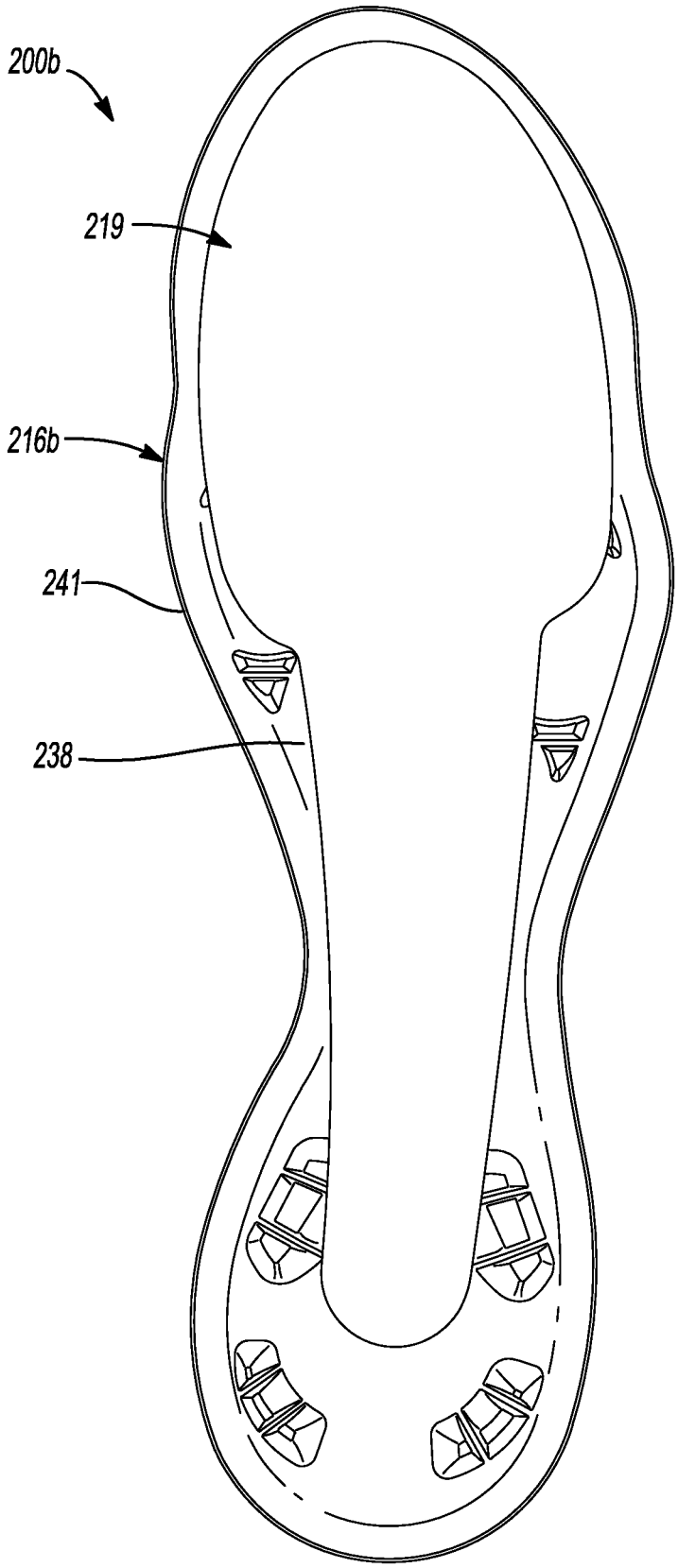
FIG. 15 is a top view of the article of footwear of FIG. 12.

As illustrated in FIGS. 13A and 13B, the sole structure 200*b* may include an upper sole plate 214*b*, a lower sole plate 216*b*, a membrane 218*b*, a shank 219, and one or more traction elements 220. In the illustrated example, the lower sole plate 216*b* extends continuously from the anterior end 18 to the posterior end 20 of the article of footwear 10, and receives each of the shank 219, the membrane 218*b*, and the upper sole plate 214*b* therein. Thus, unlike the examples above, where the upper sole plates 214, 214*a* provide the primary structure for supporting the foot and defining the ground-engaging surface 30, in the current example, the lower sole plate 216*b* provides the primary structure for supporting the foot, while the upper sole plate 214*b* provides secondary support within the sole structure 200*b*.

Referring to FIGS. 13A and 13B, the lower sole plate 216*b* may include the upper side 238, the lower side 240 opposite the upper side 238, and the peripheral edge 241 extending around the upper and lower sides 238, 240. The lower side 240 of the lower sole plate 216*b* includes a plurality of traction elements 220 formed thereon, which may optionally include traction element tips 221 that are formed separately from and are attached to the lower sole plate 216*b*.

The lower sole plate 216*b* further includes a central aperture 242-5 formed through a thickness of the lower sole plate 216*b* in the forefoot region 12. In some implementations, the central aperture 242-5 defines a through-hole extending through both the upper and lower sides 238, 240 of the lower sole plate 216*b*. The central aperture 242-5 is disposed within an interior portion of the forefoot region 12 and has a U-shaped or V-shaped construct, which effectively divides the forefoot region 12 of the lower sole plate 216*b* into a first ground-engaging portion 244 extending around the periphery of the anterior end 18, and a second ground-engaging portion 246 disposed in the interior portion of the forefoot region 12. In this regard, the second ground-engaging portion 246, and the traction elements 220 disposed thereon, may be cantilevered relative to the first ground-engaging portion 244 of the lower sole plate 216*b*. Accordingly, as discussed above with respect to the example of FIGS. 2 and 3, in order to improve traction between the lower sole plate 216*b* and the ground surface during use, the second ground-engaging portion 246 of the lower sole plate 216*b* may remain stationary, or otherwise maintain a constant orientation relative to the ground surface, while the first ground-engaging portion 244 of the lower sole plate 216*b* flexes and moves relative to both the second ground-engaging portion 246 and the ground surface 300.

Additionally, the upper side 238 of the lower sole plate 216*b* includes a plurality of recesses 239*a*-239*c* each configured to receive one of the shank 219, the membrane 218*b*, and the upper sole plate 214*b* in a nested configuration within the lower sole plate 216*b*, as discussed in greater detail below. As shown, a first one of the recesses 239*a* includes a shank recess 239*a* that extends along a central portion of the upper side 238 from a first end bounded by the central aperture 242*b* in the forefoot region 12, to a second end 274 in the heel region 16. The shank recess 239*a* is configured to receive the shank 219 therein, such that an inner peripheral profile of the shank recess 239*a* corresponds to an outer peripheral profile of the shank 219. As such, when the sole structure 200*b* is assembled, a first end of the shank 219 will be received within the first end of the shank recess 239*a* adjacent to the central aperture 242-5 to provide the second ground-engaging portion 246 of the lower plate 216*b* with additional stiffness.

With continued reference to FIG. 13B, a second one of the recesses 239*b* includes an intermediate recess 239*b* configured to situate the membrane 218*b* between the lower plate

216*b* and the shank 219 on the bottom, and the upper sole plate 214*b* on the top. Here, the intermediate recess 239*b* surrounds a perimeter of the central aperture 242-5 such that the membrane 218*b* covers the central aperture 242-5 when the sole structure 200*b* is assembled. Additionally, an inner peripheral sidewall of the intermediate recess 239*b* intersects with the inner peripheral sidewall of the shank recess 239*a*, such that a portion of the membrane 218*b* extends over the first end of the shank recess 239*a* (and the shank 219) when the sole structure 200*b* is assembled.

The plurality of recesses 239*a*-239*c* further includes an upper recess 239*c* configured to receive the upper sole plate 214*b* above each of the shank 219 and the membrane 218*b*. Accordingly, an inner peripheral sidewall of the upper recess 239*c* extends from the upper side 238 and is outwardly offset from the peripheral walls of the shank recess 239*a* and the intermediate recess 239*b*.

Figure 16:
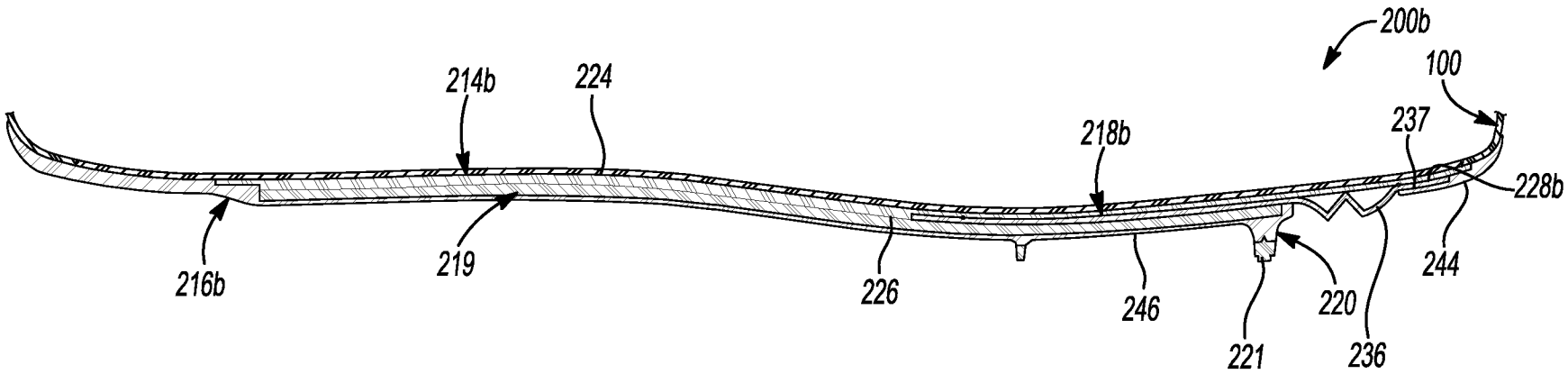
FIG. 16 is a cross-sectional view of a sole structure of the article of footwear of FIG. 12, taken along the line 16-16 of FIG. 14.
Figure 17:
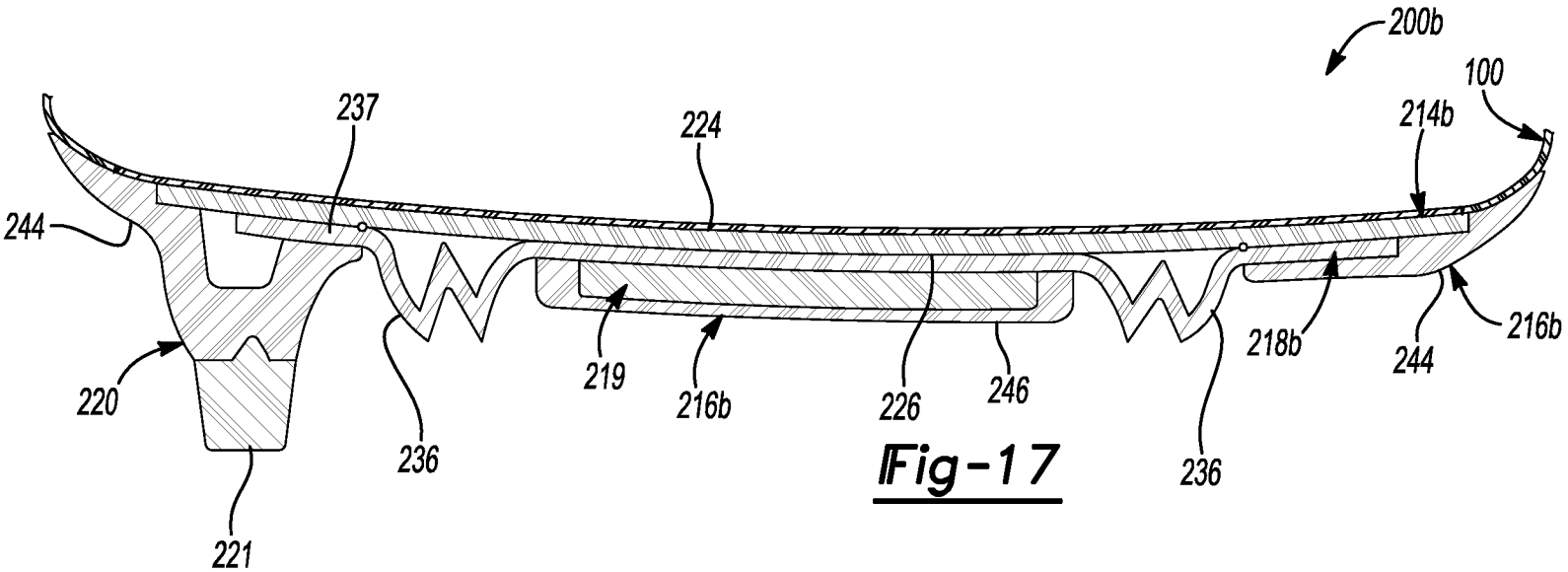
FIG. 17 is a cross-sectional view of a forefoot portion of a sole structure of the article of footwear of FIG. 12, taken along the line 17-17 of FIG. 14.

With reference to FIG. 13A, the upper sole plate 214*b* includes the upper side 224 and the lower side 226 formed on the opposite side of the upper sole plate 214*b* from the upper side 224. Here, the lower side 226 includes a recess 228*b* formed therein and configured to receive the membrane 218*b* therein. Accordingly, at least the upper side 254 of the membrane 218*b* may nest within the upper sole plate 214*b* when the sole structure 200*b* is assembled. As shown in FIGS. 16 and 17, when the sole structure 200*b* is assembled, the lower side 226 of the upper sole plate 214*b* may receive the membrane 218*b*.

Referring again to FIGS. 13A and 13B, the membrane 218*b* includes a bellows 236 configured to be disposed within the central aperture 242-5, and a peripheral flange 237 surrounding the bellows 236 and configured to be attached to the upper side 238 of the lower sole plate 216*b* within the intermediate recess 239*b*. As shown, the bellows 236 provide a flexible portion of the membrane 218*b* formed by a plurality of concertinaed sides arranged in series between the first ground-engaging portion 244 and the second ground-engaging portion 246. The peripheral flange 237 is substantially planar and surrounds the bellows 236. Here, the bellows 236 and the flange 237 may be formed of a single piece of flexible, resilient material.

The lower side 256 of the membrane 218*b* formed by the flange 237 may engage the upper side 238 of the lower sole plate 216*b* and an upper side of the shank 219 within the intermediate recess 239*b*. In some implementations, the lower side 256 of the membrane 218*b* is bonded to the upper side 238 of the lower sole plate 216*b* and the shank 219. For example, the lower side 256 of the membrane 218*b* may be bonded using an adhesive, an overmold process, or other suitable technique. The bellows 236 are disposed within the central aperture 242-5, are exposed at the central aperture 242-5, and provide a flexible zone within the central aperture 242-5 for allowing the first ground-engaging portion 244 to move relative to the second ground-engaging portion 246.

The shank 219 is configured to provide an increased stiffness along an interior portion of the sole structure 200*b*. Accordingly, the shank 219 may be formed of one or more rigid materials, including metals, polymeric materials, and/or composite materials. Optionally, a width of the shank 219 may taper along the direction of the longitudinal axis $A_F$ of the article of footwear 10*b*. Accordingly, the shank 219 may have a greater width in the forefoot region 12 than in the heel region 16. A thickness of the shank 219 is selected such that a top surface of the shank 219 is flush with a bottom surface of the intermediate recess 239*b*. Accordingly, when the shank 219 is disposed within the shank recess 239*a*, the top surface of the shank 219 and the bottom surface of the intermediate recess 239*b* cooperate to support the membrane 218*b*.

As discussed above, the shank 219 is disposed within the shank recess 239*a* such that the first end of the shank 219 is adjacent to and surrounded by the central aperture 242-5. In other words, the first end of the shank 219 overlaps the ground-engaging portion 246 of the lower sole plate 216*b* to provide the ground-engaging portion 246 with supplementary reinforcement. When the sole structure 200*b* is assembled, the first end of the shank 219 is interposed between the ground-engaging portion 246 of lower sole plate 216*b* and the membrane 218*b*. Optionally, the shank 219 may be attached to one or both of the lower sole plate 216*b* and the membrane 218*b* such that when the forefoot region 12 of the sole structure 200*b* is flexed, the ground-engaging portion 246 of the lower sole plate 216 and the interior portion of the membrane 218*b* each remain intact with the first end of the shank 219.

During engagement of the lower sole plate 216*b* with the ground surface 300, the sole structure 200*b* is configured to provide increased traction and shock absorption in the forefoot and mid-foot regions 12, 14 by allowing the traction elements 220 and the second ground-engaging portion 246 of the lower sole plate 216*b* to maintain engagement with the ground surface 300 for a longer period of time than an area (e.g., the first ground-engaging portion 244) of the lower sole plate 216*b* extending around, and immediately adjacent to, the second ground-engaging portion 246 of the plate.

The following Clauses provide exemplary configurations of the sole structure and article of footwear described above.

Clause 1. A sole structure for an article of footwear, the sole structure including a first sole plate formed at least in part from a first material having a first stiffness and including a first ground-engaging portion and a second ground-engaging portion, the first ground-engaging portion defining a first aperture extending around the second ground-engaging portion. The sole structure further including a membrane coupled to the first ground-engaging portion and the second ground-engaging portion and at least partially exposed by the first aperture, the membrane formed at least in part from a second material having a second stiffness that is less than the first stiffness.

Clause 2. The sole structure of Clause 1, wherein the first material has a first modulus of elasticity, and the second material has a second modulus of elasticity different than the first modulus of elasticity.

Clause 3. The sole structure of any of the preceding clauses, further comprising a second sole plate, the membrane being disposed between the first sole plate and the second sole plate.

Clause 4. The sole structure of Clause 3, wherein the second sole plate defines a recess, the membrane being disposed within the recess.

Clause 5. The sole structure of Clause 4, wherein the first sole plate is disposed within the recess.

Clause 6. The sole structure of any of the preceding clauses, wherein the first aperture defines one of a V-shape or a U-shape.

Clause 7. The sole structure of any of the preceding clauses, wherein the membrane is at least partially disposed within the first aperture.

Clause 8. The sole structure of Clause 7, wherein the membrane defines a first protrusion at least partially disposed within the first aperture.

Clause 9. The sole structure of Clause 8, wherein the first protrusion defines one of a V-shape or a U-shape.

Clause 10. The sole structure of any of the preceding clauses, wherein the second ground-engaging portion is cantilevered from the first ground-engaging portion.

Clause 11. The sole structure of any of the preceding clauses, further comprising a traction element disposed on the second ground-engaging portion.

Clause 12. The sole structure of any of the preceding clauses, wherein the second ground-engaging portion is configured to move relative to the first ground-engaging portion when the first sole plate flexes from a first position to a second position.

Clause 13. An article of footwear incorporating the sole structure of any of the preceding clauses.

Clause 14. A sole structure for an article of footwear, the sole structure including a first sole plate formed at least in part from a first material having a first stiffness and including a first ground-engaging portion and a second ground-engaging portion, the second ground-engaging portion cantilevered from the first ground-engaging portion and extending into a first aperture defined by the first ground-engaging portion. The sole structure further including a membrane coupled to the first ground-engaging portion and the second ground-engaging portion and at least partially exposed by the first aperture, the membrane formed at least in part from a second material having a second stiffness that is less than the first stiffness.

Clause 15. The sole structure of Clause 14, wherein the first material has a first modulus of elasticity, and the second material has a second modulus of elasticity different than the first modulus of elasticity.

Clause 16. The sole structure of any of the preceding clauses, further comprising a second sole plate, the membrane being disposed between the first sole plate and the second sole plate.

Clause 17. The sole structure of Clause 16, wherein the second sole plate defines a recess, the membrane being disposed within the recess.

Clause 18. The sole structure of Clause 17, wherein the first sole plate is disposed within the recess.

Clause 19. The sole structure of any of the preceding clauses, wherein the first aperture defines one of a V-shape or a U-shape.

Clause 20. The sole structure of any of the preceding clauses, wherein the membrane is at least partially disposed within the first aperture.

Clause 21. The sole structure of Clause 20, wherein the membrane defines a first protrusion at least partially disposed within the first aperture.

Clause 22. The sole structure of Clause 21, wherein the first protrusion defines one of a V-shape or a U-shape.

Clause 23. The sole structure of any of the preceding clauses, further comprising a traction element disposed on the second ground-engaging portion.

Clause 24. The sole structure of any of the preceding clauses, wherein the second ground-engaging portion is configured to move relative to the first ground-engaging portion when the first sole plate flexes from a first position to a second position.

Clause 25. An article of footwear incorporating the sole structure of any of the preceding clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a first sole plate formed at least in part from a first material having a first stiffness and including a first ground-engaging portion and a second ground-engaging portion, the first ground-engaging portion defining a first aperture extending around the second ground-engaging portion;

a second sole plate formed at least in part from a second material having a second stiffness; and a membrane disposed between the first sole plate and the second sole plate, coupled to the first ground-engaging portion and the second ground-engaging portion, and at least partially exposed by the first aperture, the membrane formed at least in part from a third material having a third stiffness that is less than the first stiffness and the second stiffness.

2. The sole structure of claim 1, wherein the first material has a first modulus of elasticity, and the third material has a second modulus of elasticity different than the first modulus of elasticity.

3. The sole structure of claim 1, wherein the first aperture defines one of a V-shape or a U-shape.

4. The sole structure of claim 1, wherein the membrane is at least partially disposed within the first aperture.

5. The sole structure of claim 4, wherein the membrane defines a first protrusion at least partially disposed within the first aperture.

6. The sole structure of claim 5, wherein the first protrusion defines one of a V-shape or a U-shape.

7. The sole structure of claim 1, wherein the second ground-engaging portion is cantilevered from the first ground-engaging portion.

8. The sole structure of claim 1, further comprising a traction element disposed on the second ground-engaging portion.

9. The sole structure of claim 1, wherein the second ground-engaging portion is configured to move relative to the first ground-engaging portion when the first sole plate flexes from a first position to a second position.

10. A sole structure for an article of footwear, the sole structure comprising:

a first sole plate formed at least in part from a first material having a first stiffness and including a first ground-engaging portion and a second ground-engaging portion, the second ground-engaging portion cantilevered from the first ground-engaging portion and extending into a first aperture defined by the first ground-engaging portion;

a second sole plate formed at least in part from a second material having a second stiffness; and a membrane disposed between the first sole plate and the second sole plate, coupled to the first ground-engaging portion and the second ground-engaging portion and at least partially exposed by the first aperture, the membrane formed at least in part from a third material having a third stiffness that is less than the first stiffness and the second stiffness.

11. The sole structure of claim 10, wherein the first material has a first modulus of elasticity, and the third material has a second modulus of elasticity different than the first modulus of elasticity.

12. The sole structure of claim 10, wherein the membrane is received within a recess formed in one of the first sole plate or the second sole plate.

13. The sole structure of claim 10, wherein the first aperture defines one of a V-shape or a U-shape.

14. The sole structure of claim 10, wherein the membrane is at least partially disposed within the first aperture.

15. The sole structure of claim 14, wherein the membrane defines a first protrusion at least partially disposed within the first aperture.

16. The sole structure of claim 15, wherein the first protrusion defines one of a V-shape or a U-shape.

17. The sole structure of claim 10, further comprising a traction element disposed on the second ground-engaging portion.

18. The sole structure of claim 10, wherein the second ground-engaging portion is configured to move relative to the first ground-engaging portion when the first sole plate flexes from a first position to a second position.

* * * * *